United States Patent [19]

Mascotte

[11] Patent Number: 4,731,952

[45] Date of Patent: Mar. 22, 1988

[54] DOOR FRAME HAVING ADJUSTABLE THRESHOLD MEMBER

[76] Inventor: Lawrence L. Mascotte, 9106 SE. 82nd, Portland, Oreg. 97266

[21] Appl. No.: 28,863

[22] Filed: Mar. 23, 1987

[51] Int. Cl.[4] ..... E06B 1/70

[52] U.S. Cl. ..... 49/380; 49/62; 49/468; 49/505

[58] Field of Search ..... 49/504, 505, 468, 61, 49/67, 68, 380, 467; 52/79.6, 79.12; 160/351

[56] References Cited

U.S. PATENT DOCUMENTS

| | | | |
|---|---|---|---|
| 939,004 | 11/1909 | Gill | 49/380 |
| 3,348,345 | 10/1967 | Byers et al. | 52/79.6 |
| 3,715,837 | 2/1973 | Hamel | 49/380 |
| 3,778,931 | 12/1973 | Donaldson | 49/380 |
| 4,001,972 | 1/1977 | Hurwitz | 49/380 |
| 4,282,689 | 8/1981 | Royer | 49/67 |
| 4,531,337 | 7/1985 | Holdiman | 49/505 |

*Primary Examiner*—Kenneth J. Dorner
*Assistant Examiner*—Gerald A. Anderson
*Attorney, Agent, or Firm*—Adrian J. LaRue

[57] ABSTRACT

A metal door frame for mounting onto an existing wood door frame of a building comprises side and top members that are to be secured onto respective side and top sections of the existing door frame. A threshold member is mounted onto or into the bottoms of the side members of the outer door frame, the threshold member being adjustable relative to the side members enabling the threshold member to engage and extend along the threshold of the existing frame regardless of the position of the existing threshold.

5 Claims, 5 Drawing Figures

DOOR FRAME HAVING ADJUSTABLE THRESHOLD MEMBER

FIELD OF THE INVENTION

This invention relates to door frames and more particularly to metal door frames to be mounted onto existing wood door frames and having an adjustable threshold member.

BACKGROUND OF THE INVENTION

In U.S. patent application Ser. No. 767,889 filed Aug. 21, 1985, a door frame is secured to an existing wood door frame of a house or building. The door frame is then used as part of a locking system for a security door that is hingedly mounted on the door frame. The door frame is made of tubular metal with the threshold member being secured to the bottoms of the side members of the door frame. This creates a problem when the threshold of the existing door frame is not true or level, which is generally the case, because the treshold member of the door frame to be mounted onto the existing door frame will not be in alignment with the existing threshold. The non-aligned threshold and threshold member will be difficult to seal and will create misalignment between the threshold and threshold member.

SUMMARY OF THE INVENTION

According to the present invention, a metal door frame for mounting onto an existing wood door frame of a building comprises side and top members that are to be secured onto respective side and top sections of the existing door frame. A threshold member is mounted onto or into the bottoms of the side members of the outer door frame, the threshold member being adjustable relative to the side members enabling the threshold member to engage and extend along the threshold of the existing door frame regardless of the position of the existing threshold.

DETAILED DESCRIPTION OF THE INVENTION

Figure 1:
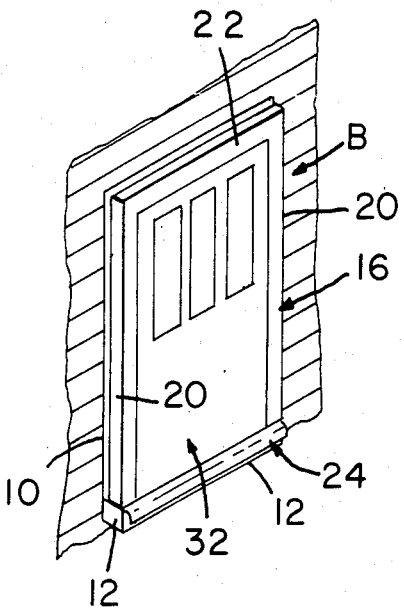
FIG. 1 is a part perspective view of a building including a door.
Figure 2:
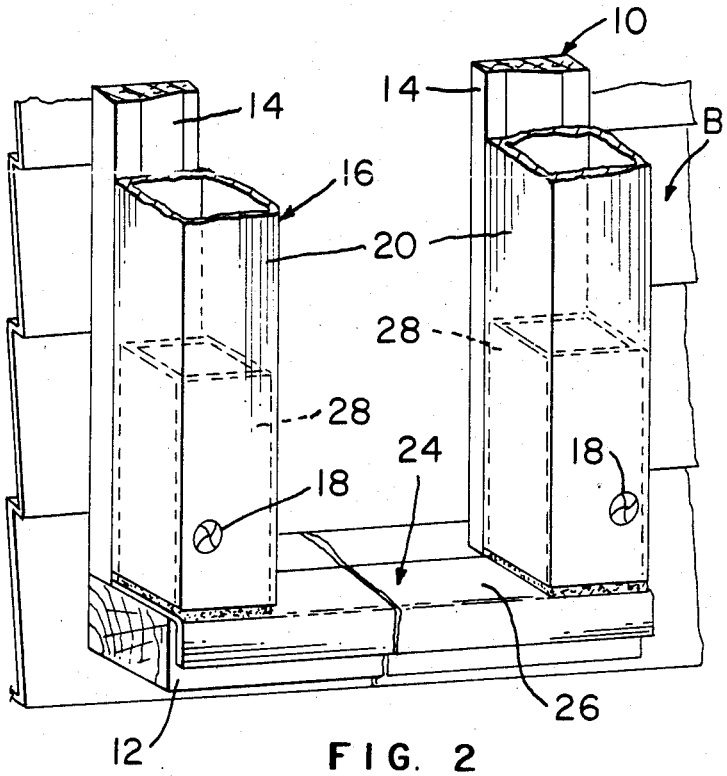
FIG. 2 is a part perspective and enlarged view showing an existing door frame and an outer door frame secured thereto.
Figure 3:
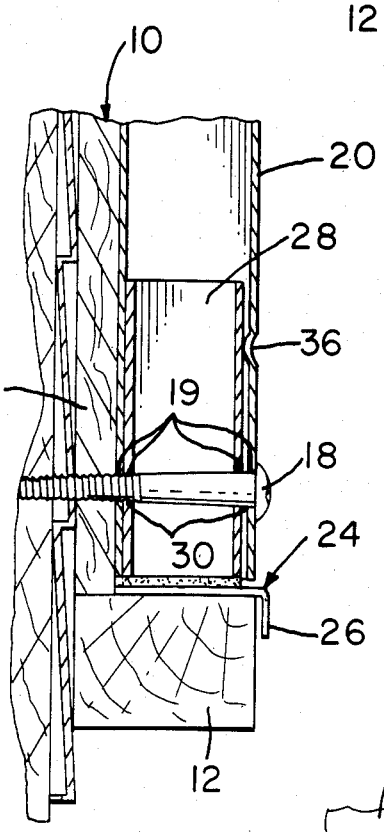
FIG. 3 is a cross-sectional view of one of the side members of FIG. 2.
Figure 4:
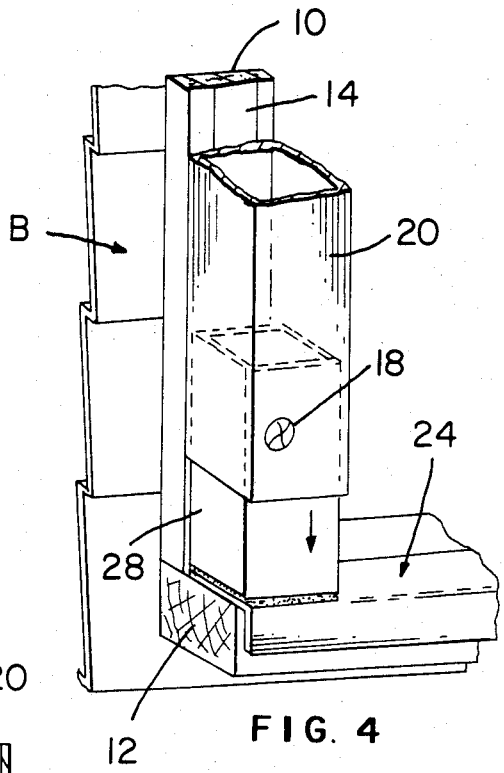
FIG. 4 is a part perspective view similar to FIG. 2 showing the threshold member adjusted relative to the side member.

FIG. 1 shows a building B, such as a house, which includes a doorway around the outside of which is secured an existing door frame 10 which is better shown in FIGS. 2–4. Frame 10 includes a threshold 12 at the bottom of side members 14 of frame 10. A door (not shown) is hingedly mounted to the door jam.

A tubular metal frame 16 is secured onto an existing door frame 10 by one way lag screws 18 which extend through holes 19 at spaced locations along side members 20 and top member 22 of frame 16. Holes 19 are located toward the outer edges of members 20,22 so that screws 18 can be screwed into the frame members that form the doorway of the building. This will secure frame 16 in position on an existing frame 10.

Threshold member 24 is part of frame 16 and includes an L-shaped metal plate 26 and metal tubular members 28 which are secured as by welding to respective ends of plate 26. Tubular members 28 are initially disposed within respective tubular side members 20 of frame 16 and are in position therein when frame 16 is secured onto existing frame 10. Tubular members 28 fit tightly within tubular side members 20 so that threshold member 24 will stay in position as part of frame 16.

If threshold 12 is true when frame 16 is secured onto frame 10, threshold member 24 will extend along and engage threshold 12 as shown in FIG. 2 without adjusting threshold member 24 relative to frame 16. Holes 30 are drilled in members 28 using holes 19 as a guide whereafter lag screws 18 are positioned in holes 19,28 and screwed into the door frame thereby securing threshold member 24 and the bottoms of members 20 in position as shown in FIG. 3.

If threshold 12 is not true when frame 16 is secured onto frame 10, threshold member 24 can be moved relative to side members 20 by use of a hammer to move plate 26 into engagement with threshold 12. This will cause tubular members 28 to move relative to side members 20 as shown in FIG. 4. Holes 30 are then drilled through tubular members 28 so as to be aligned with holes 19 in side members 20 whereafter lag screws 18 are positioned in holes 19,28 and screwed into the door frame thereby securing threshold member 24 and the bottoms of members 20 in position as shown in FIG. 4.

In this way, threshold member 24 can be brought into engagement with the existing threshold and be in alignment therewith which will result in a sealed condition when door 32 (FIG. 1) is hingedly mounted on frame 16 and acts as a storm security door.

With tubular members 28 and the bottoms of side members 20 secured in position by lag screws 18, this prevents side members 20 from moving in and out thereby maintaining frame 16 in position on frame 10 enabling door 32 to latch properly and not rub on the side member 20 containing the latch or rub onto threshold 24.

Metal plate 26 of threshold member 24 can take any desired configuration to conform to any existing threshold so as to extend along and engage such threshold. Thus, metal plate 26 forms a seal with threshold 12 or sealing material can be disposed between the inner surface of metal plate 26 and threshold 12 if desired.

Figure 5:
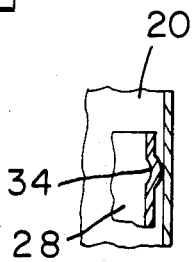
FIG. 5 is a fragmentary cross-sectional view of an alternative embodiment of the invention.

Tubular members 28 can be provided with outwardly-directed projections 23 that engage the inside surfaces of tubular members 20 so as to maintain tubular members 28 within tubular members 20 as shown in FIG. 5. Alternatively, tubular members 20 can include inwardly-directed projections 36 that engage tubular members 28 when they are positioned in tubular members 20 thereby maintaining them therein as shown in FIG. 3.

As can be discerned, a door frame securable onto an existing door frame of a building includes an adjustable threshold member that is adjustable relative to its door frame so as to be moved into engagement with the threshold of the existing door frame.

I claim:

1. A door frame for engagement with an existing door frame of a building and to be secured thereto, comprising:

top and side members for engagement with and to be secured to respective top and side sections of the existing door frame;

a threshold member mounted to the bottoms of said side members for extension along and for engagement with the threshold of the existing door frame; and means provided by said side members and said threshold member enabling said threshold member to be adjusted relative to said side members so as to extend along and engage the threshold of the existing door frame subsequent to the side members being secured to the existing door frame.

2. A door frame as claimed in claim 1, wherein the side members are tubular metal members.

3. A door frame as claimed in claim 2, wherein said threshold member includes a metal plate member and metal tubular members at respective ends of said metal plate member, said metal tubular members frictionally fitting within the bottoms of respective tubular metal side members.

4. A door frame as claimed in claim 3, wherein said side members have inwardly-directed projection means engaging with said metal tubular members.

5. A door frame as claimed in claim 3, wherein said metal tubular members have outwardly-directed projection means engaging with said side members.

* * * * *